US010605522B2

(12) United States Patent
Mak et al.

(10) Patent No.: US 10,605,522 B2
(45) Date of Patent: Mar. 31, 2020

(54) METHODS AND CONFIGURATIONS FOR LNG LIQUEFACTION

(71) Applicant: Fluor Technologies Corporation, Sugar Land, TX (US)

(72) Inventors: John Mak, Santa Ana, CA (US); Jacob Thomas, Sugar Land, TX (US); Dhirav Patel, Sugar Land, TX (US); Steven Borsos, Houston, TX (US)

(73) Assignee: Fluor Technologies Corporation, Sugar Land, TX (US)

( * ) Notice: Subject to any disclaimer, the term of this patent is extended or adjusted under 35 U.S.C. 154(b) by 179 days.

(21) Appl. No.: 15/693,767

(22) Filed: Sep. 1, 2017

(65) Prior Publication Data

US 2018/0058753 A1 Mar. 1, 2018

Related U.S. Application Data

(60) Provisional application No. 62/382,605, filed on Sep. 1, 2016.

(51) Int. Cl.
*F25J 1/02* (2006.01)
*F25J 1/00* (2006.01)

(52) U.S. Cl.
CPC ..... *F25J 1/0037* (2013.01); *F25J 1/0022* (2013.01); *F25J 1/0035* (2013.01); *F25J 1/0052* (2013.01); *F25J 1/0204* (2013.01); *F25J 1/0208* (2013.01); *F25J 1/0254* (2013.01); *F25J 1/0265* (2013.01); *F25J 1/0267* (2013.01); *F25J 1/0296* (2013.01); *F25J 2215/04* (2013.01); *F25J 2220/60* (2013.01); *F25J 2220/66* (2013.01); *F25J 2230/04* (2013.01); *F25J 2230/20* (2013.01); *F25J 2230/30* (2013.01); *F25J 2230/60* (2013.01); *F25J 2240/02* (2013.01); *F25J 2245/02* (2013.01); *F25J 2270/06* (2013.01)

(58) Field of Classification Search
CPC ..... F25J 1/0037; F25J 1/0022; F25J 1/0052; F25J 2215/04; F25J 2245/02
See application file for complete search history.

(56) References Cited

U.S. PATENT DOCUMENTS 5,956,971 A * 9/1999 Cole ..... F25J 1/0202 62/623
6,023,942 A * 2/2000 Thomas ..... B23K 9/173 62/613

(Continued)

OTHER PUBLICATIONS

Mak, John et al., "Methods and Configurations for LNG Liquefaction", filed Sep. 1, 216, U.S. Appl. No. 62/382,605.

*Primary Examiner* — Frantz F Jules
*Assistant Examiner* — Lionel Nouketcha
(74) *Attorney, Agent, or Firm* — Conley Rose, PC

(57) ABSTRACT

Embodiments relate generally to systems and methods for pre-cooling a natural gas stream to a liquefaction plant. A system may comprise a compressor configured to receive a first natural gas stream at a first pressure and produce a second natural gas stream at a second pressure; an exchanger, wherein the exchanger is configured to receive the second natural gas stream as the second pressure and cool the second natural gas stream to produce a cooled natural gas stream; and an expander, wherein the expander is configured to receive the cooled natural gas stream and expand the cooled natural gas stream from the second pressure to a third pressure.

17 Claims, 3 Drawing Sheets

(56) References Cited

U.S. PATENT DOCUMENTS

| | | | | |
|---|---|---|---|---|
| 7,644,595 | B2 | 1/2010 | Reddy | |
| 8,893,515 | B2 * | 11/2014 | Mak | F17C 9/04 62/48.2 |
| 9,021,832 | B2 * | 5/2015 | Pierce | F25J 3/0209 62/611 |
| 2007/0157663 | A1 * | 7/2007 | Mak | F25J 1/0022 62/620 |
| 2014/0318178 | A1 * | 10/2014 | Del Campo | F25J 1/0022 62/613 |

* cited by examiner

METHODS AND CONFIGURATIONS FOR LNG LIQUEFACTION

CROSS-REFERENCE TO RELATED APPLICATIONS

The present application claims priority to U.S. Provisional Patent Application Ser. No. 62/382,605 filed Sep. 1, 2016 by John Mak, et al. and entitled "Methods and Configurations for LNG Liquefaction" which is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Natural gas supply in North America is continually growing, mostly due to the production of new shale gas, recent discoveries of offshore gas fields, and to a lesser extent, stranded natural gas brought to market after construction of the Alaska natural gas pipeline, and it is believed that shale gas and coal-bed methane will make up the majority of the future growth in the energy market.

While natural gas supply is increasing, crude oil supply is depleting as there are no significant new discoveries of oil reserves. If this trend continues, transportation fuel derived from crude oil will soon become cost prohibitive, and alternate renewable fuels (and particularly transportation fuels) are needed. Moreover, since combustion of natural gas also produces significantly less CO2 as compared to other fossil materials (e.g., coal or gasoline), use of natural gas is even more desirable. Natural gas used for transportation fuel must be in a denser form, either as compressed natural gas (CNG) or liquefied natural gas (LNG). CNG is produced by compression of natural gas to very high pressures of about 3000 to 4000 psig. However, even at such pressures, the density of CNG is relatively low, and storage at high pressure requires heavy weight vessels and is potentially a hazard. On the other hand, LNG has a significantly higher density and can be stored at relatively low pressures of about 20 to 150 psig. Still further, LNG is a safer fuel than CNG, as it is at a lower pressure and not combustible until it is vaporized and mixed with air in the proper ratio. Nevertheless, CNG is more common than LNG as a transportation fuel, mainly due to the cost of high liquefaction and the lack of infrastructure to support LNG fueling facilities.

LNG can be used to replace diesel and is presently used in many heavy duty vehicles, including refuse haulers, grocery delivery trucks, transit buses, and coal miner lifters. To increase the LNG fuel markets, small to mid-scale LNG plants must be constructed close to both pipelines and LNG consumers, as long distance transfer of LNG is costly and therefore often not economical. Such small to mid-scale LNG plants should be designed to produce 0.2 mtpy to 2.0 million metric tons per year (mmtpy). Moreover, such small to mid-scale LNG plants must be simple in design, easy to operate, and sufficiently robust to support an unmanned operation. Still further, it would be desirable to integrate liquefaction with LNG truck fueling operations to allow for even greater delivery flexibility.

Various refrigeration processes are used for LNG liquefaction. The most common of these refrigeration processes are the cascade process, the mixed refrigerant process, and the propane pre-cooled mixed refrigerant process. While these methods are energy efficient, such methods are often complex and require circulating several hydrocarbon refrigerants or mixed hydrocarbon refrigerants. Unfortunately, such refrigerants (e.g., propane, ethylene, and propylene) are explosive and hazardous in the event of leakage.

There are several recent innovations in LNG plant design. For example, U.S. Pat. No. 5,755,114 to Foglietta teaches a hybrid liquefaction cycle which includes a closed loop propane refrigeration cycle and a turboexpander cycle. Compared to other liquefaction processes, the liquefaction process has been simplified, but is still unsuitable and/or economically unattractive for small to mid-scale LNG plants. U.S. Pat. No. 7,673,476 to Whitesell discloses a compact and modular liquefaction system that requires no external refrigeration. The system uses gas expansion by recycling feed gas to generate cooling. While this design is relatively compact, operation of the recycle system is complicated, and the use of hydrocarbon gas for cooling remains a safety concern. U.S. Pat. No. 5,363,655 to Kikkawa teaches the use of a gas expander and plate and fin heat exchangers for LNG liquefaction. While providing several advantages, such process is still too complex and costly for small to mid-scale LNG plants.

Further compounding the above noted drawbacks is the fact that most of the systems lack the capability for integration of a small to mid-scale LNG plant with an LNG loading operation. Thus, the current practice for loading an LNG truck generally requires an LNG pump to pump the LNG from the storage tanks to the LNG trucks. Remarkably, the boil-off vapors generated during the LNG truck loading operation are vented to the atmosphere which is a safety hazard and creates emission pollution.

Thus, various disadvantages remain. Among other things, most of the LNG liquefaction methods and configurations are complex and costly and hence unsuitable for the small to mid-scale LNG plants. In addition, most liquefaction plants lack an integrated system for LNG loading operations, which is highly desirable for small to mid-scale LNG plants.

SUMMARY

In an embodiment, a system for pre-cooling a natural gas stream to a liquefaction plant may comprise a compressor configured to receive a first natural gas stream at a first pressure and produce a second natural gas stream at a second pressure; an exchanger, wherein the exchanger is configured to receive the second natural gas stream as the second pressure and cool the second natural gas stream to produce a cooled natural gas stream; and an expander, wherein the expander is configured to receive the cooled natural gas stream and expand the cooled natural gas stream from the second pressure to a third pressure.

In an embodiment, a system may comprise a first compressor configured to receive a natural gas feed stream at a first pressure and compress the natural gas feed stream to produce a first compressed stream at a second pressure; a first heat exchanger configured to cool the first compressed stream at the second pressure; a second compressor configured to receive the first compressed stream at the second pressure and compress the first compressed stream to produce a second compressed stream at a third pressure; a second heat exchanger configured to cool the second compressed stream at the third pressure; an expander configured to receive the second compressed stream at the third pressure from the second heat exchanger and expand the second compressed stream to produce an expanded natural gas stream at a fourth pressure; and an LNG liquefaction system comprising a refrigeration loop, wherein the refrigeration loop comprises a heat exchanger configured to receive at least a portion of the expanded natural gas stream as a cooling stream in the refrigeration loop.

In an embodiment, a method may comprise compressing and cooling a natural gas stream to produce a compressed natural gas stream, wherein the natural gas stream is at a first pressure and a first temperature; and expanding the compressed natural gas stream to produce a chilled natural gas stream, wherein the chilled natural gas stream is at a second pressure and a second temperature, wherein the first temperature is higher than the second temperature.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
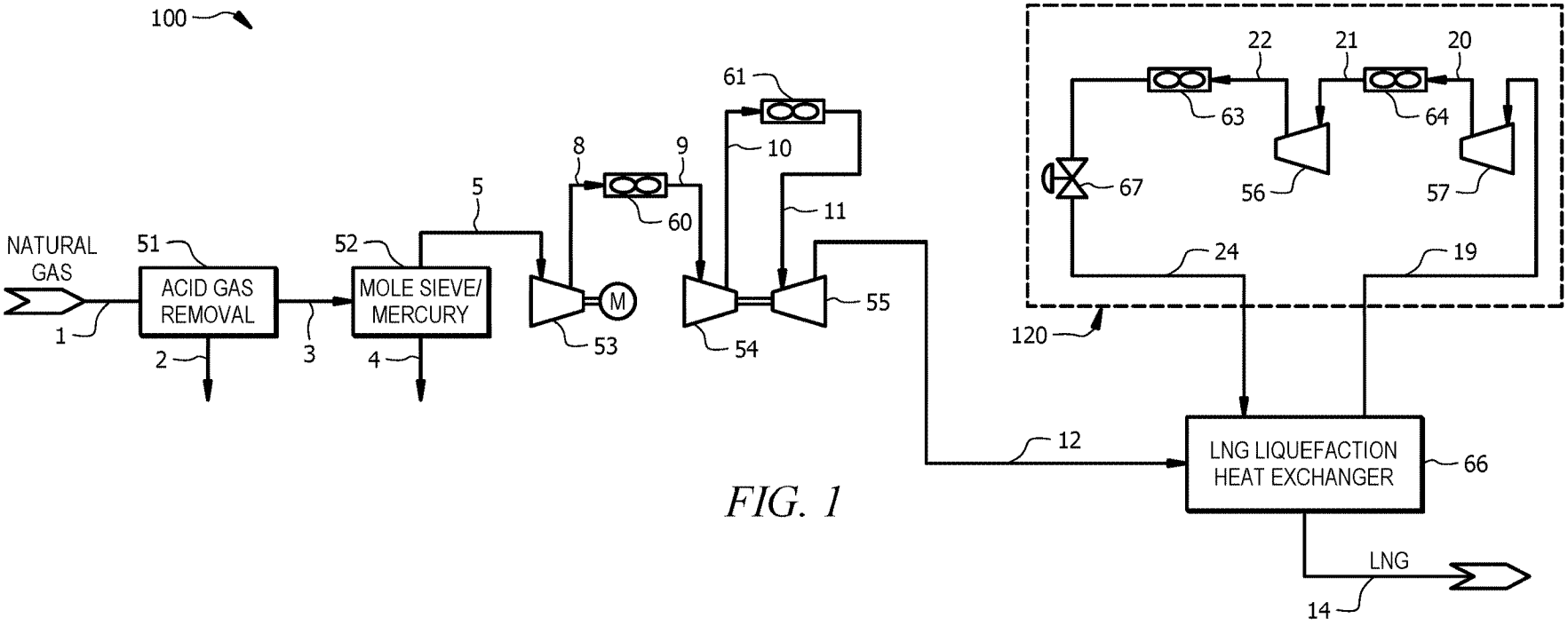
FIG. 1 illustrates a process including a refrigeration circuit according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

The field of the systems and methods described herein is liquefied natural gas (LNG) liquefaction, especially on the gas compression cooling methods to precool feed gas to a LNG liquefaction plant. The present disclosure is related to small scale to mid-scale LNG liquefaction plants with capacities of 0.5 to 3 million metric tons per year (mmtpy) and is applicable to various types of liquefaction processes including mixed refrigerant cycles and nitrogen expander cycles, either for grass-root installation or debottlenecking an existing facility.

With the exploration and development of unconventional resources, such as shale gas, tight gas, and coal bed methane gas, natural gases are becoming the main energy source for the years to come. Shale gas fields are located in remote areas and in dispersed locations, which would require construction of costly pipelines to bring the gas to the consumers. In many instances, it is more economical to liquefy the natural gas on site so that it can be transported to the consumers by trucks or tankers. These unconventional fields are generally smaller than "traditional" gas reservoirs, such that application of complex LNG liquefaction processes is not appropriate.

Small to mid-scale LNG plants are typically defined with liquefaction capacities from 0.1 to 2.0 mmtpy. These smaller plants must be simple in design, safe, easy to operate, and robust with consideration of limited staffing in plant operation. The simpler processes, such as the single mixed refrigerant (SMR) cycle or the nitrogen expander cycle, are preferred despite their lower thermal efficiency.

Various refrigeration processes can be used for LNG liquefaction. For example, some refrigeration processes can include the cascade process, the mixed refrigerant process, and the propane pre-cooled mixed refrigerant process. Most of the world's baseload LNG plants (i.e., plants producing more than 4 mmtpy) use propane precooled cycle and mixed refrigerant cycle or cascade refrigerant cycle using multiple pure refrigerants. While these known methods are energy efficient, such methods are often complex, requiring circulating several levels of pure hydrocarbon refrigerants or multiple mixed hydrocarbon refrigerants. In almost all cases, the liquefaction process requires a precooling stage mostly supplied by propane refrigerant or mixed refrigerant. Several precooling refrigerants are also applicable, such as ammonia, carbon dioxide, and/or lithium bromide (LiBr) for improving the liquefaction cycle efficiency. However, such precooling systems are complex and costly to operate, and in offshore situations, such as Floating LNG (FLNG), the real estate for installing these precooling units may not be available.

Most in the industry regard the nitrogen ($N_2$) expansion cycle as a well-established, robust and easy-to-operate technology, albeit one that was once considered less efficient than the SMR cycle. However, unique factors in today's LNG marketplace have made the $N_2$ expansion cycle a process of choice in many new, small-scale LNG markets. The main advantage of the $N_2$ expansion cycle is that there is no hydrocarbon liquid inventory, such that the design is inherently safe. Being a gas phase operation, there are no two-phase distribution problems (that may be associated with the SMR cycle), and the $N_2$ system can be turned down as needed to meet the demand curve. For offshore applications, the $N_2$ system performance is not impacted by ship motion and is the process of choice for ship-based floating liquefaction plants. In a congested space as in an offshore facility, flammable inventories are frequently occupied by personnel, and there is a strong incentive to minimize the risk of catastrophic loss, and hence the $N_2$ expander cycle is the process of choice.

Over the years, nitrogen expander cycle efficiency has been improved by advances in equipment designs, such as turbo-expanders, compressors, heat exchangers, brazed aluminum heat exchangers, and process configurations on multi-stage design. While equipment efficiency has reached its limit, the next step to further the improvement is to develop an economical method in precooling the feed gas to eliminate the temperature approach inefficiency.

From another perspective, feed gas pressure, typically supplied from pipelines, can vary from 600 to 800 psig. This would require gas compression as most LNG liquefaction processes are designed for 900 psig or higher feed pressure. For SMR and $N_2$ expander cycles, liquefaction cycle efficiency is strongly dependent on the feed temperature and pressure; and for a given gas turbine driver, LNG throughput can be increased when feed gas is supplied at a higher pressure and a lower temperature.

Thus, while all or almost all of the known configurations and methods provide some advantages over previously-known configurations, various disadvantages remain. Among the choice of small liquefaction plants, single mixed refrigerant and nitrogen expander cycle are suitable, but their thermal efficiencies are lower than that of the larger plants, unless a feed gas cooling method is used.

The present systems and methods are directed to feed gas compression, expansion, and cooling systems that can be used to increase the natural gas liquefaction efficiency, resulting in lowering liquefaction power consumption and/or increasing plant capacity. Most preferably, natural gas (e.g., delivered from a pipeline) is compressed, expanded, and cooled providing a chilled high pressure gas to the liquefaction plant, and optionally generating a further expanded gas to provide a portion of the chilling duty to the refrigeration compressor, further reducing the energy consumption of the LNG liquefaction process. With the contemplated methods and configurations, the specific power consumption for LNG liquefaction is significantly reduced compared to conventional processes, typically in the range of 300 to 400 kW/ton.

Viewed from another standpoint, the contemplated process can increase LNG liquefaction throughput for a given gas turbine driver, and is applicable to grass root installation or debottlenecking an existing LNG liquefaction facility.

Yet from another standpoint, the contemplated configuration can reduce carbon dioxide emissions from the gas turbines employed in the liquefaction process, as lower feed temperature reduces the cooling duty, lowering the power consumption of the refrigeration compressors in the liquefaction plant.

The contemplated configurations are applicable to the mixed refrigerant cycles and the nitrogen expansion cycles and can be used to liquefy feed gas with varying compositions, temperatures, and pressures, without impacting the refrigeration system.

Another advantage in contemplated configurations and methods is that heavy hydrocarbons and aromatics, such as benzenes, can be removed in the cooling step, avoiding waxing and plugging problems and potential damages of the cryogenic heat exchanger.

In some configurations, the compression system consists of a compressor driven by the expander, which lowers the gas temperature to the liquefaction plant. Preferably, feed gas is compressed, with inter-cooling, to at least 1800 to 2200 psig, and then expanded to 900 psig or higher, providing a feed gas with a chilled temperature at least 10° to 20° F. In many instances, additional expander compressor sets may be used to chill the refrigerant in the refrigeration cycle. This is especially necessary when existing LNG liquefaction plants are required to increase throughput to meet demands, the additional chilling can debottleneck the system, increasing the LNG liquefaction throughput without resorting to revamping the existing facility.

The term "expander compressor" as used herein refers to single-stage or multi-stage expander compressors with or without interstage cooling or interstage cooling with liquids separation, where separated liquid product can be processed offsite. The LPG product can be used for blending with the LNG product to increase its heating value. The compressor typically comprises an axial compressor, a centrifugal compressor, or like compressors with a polytropic efficiency of 82 to 87% or higher, while the expander can be an axial machine with adiabatic efficiency of 84 to 88% or higher.

While some power is recovered by expander for compression, supplementary power is required by an electric motor to meet the required pressure. Electric motors with 98% or higher efficiency are used to supplement the power requirement and can be configured as a separate unit, an integrated unit, or in tandem with the compressor. The selection of the expander compressor configuration is dependent on feed gas flow rates, temperatures, pressures, and the fit to expander machinery frame size.

In some embodiments, a compression expansion cooling configuration can be efficiently applied to small to mid-scale LNG liquefaction plants with a capacity of typically 0.1 to 0.7 mmtpy, typically between 0.7 to 1.5 mmtpy, and most typically between 1.5 to 2.5 mmtpy of LNG by liquefaction of appropriate quantities of feed gas. For some applications, the contemplated process may also be suitable for producing LNG below 0.1 mmtpy. In further particularly preferred aspects, the refrigeration process uses a non-hydrocarbon refrigerant (e.g., nitrogen), or a single mixture of hydrocarbons and nitrogen refrigerant; and preferably a non-hydrocarbon refrigerant so as to avoid the safety issues commonly associated with a hydrocarbon refrigeration system, particularly in offshore or FLNG applications.

FIG. 1 illustrates a process 100 where a natural gas stream 1 is fed to an acid gas removal unit 51. The acid gas removal unit 51 may produce a removed acid stream 2 and a treated gas stream 3, where the treated gas stream 3 may be fed to a molecular sieve dryer unit 52 to remove mercury content from the treated gas stream 3 and produce a removed mercury stream 4 and a dried gas stream 5. The dried gas stream 5 may be fed to a compressor 53, where the compressor 53 may be driven by an electric motor. The dried gas stream 5 may be compressed by the compressor 53 to produce stream 8, which may be cooled in an air cooler 60 producing a cooled gas stream 9. The cooled gas stream 9 may be further compressed by compressor 54, where the compressor 54 may be driven by an expander 55, producing stream 10. Stream 10 may be cooled in another air cooler 61, producing a high pressure gas stream 11. The high pressure gas stream 11 may be expanded in expander 55 to produce cold high pressure gas stream 12, where the cold high pressure gas stream 12 may be controlled to appropriate conditions for entering the LNG liquefaction heat exchanger 66.

The low feed gas temperature coupled with high pressure can reduce the power required by the refrigeration compressor in the liquefaction process. The refrigeration compressor is typically driven by at least two compression stages. The refrigerant fluid can be single or multiple mixed refrigerant or nitrogen in a multiple stage expander cycle.

In the refrigeration circuit 120, a low pressure refrigerant stream 19 may be compressed in a low pressure compressor 57 producing an intermediate pressure stream 20. Stream 20 may be cooled in air cooler 64, forming stream 21, which may be further compressed in compressor 56 producing a high pressure gas stream 22. The high pressure gas stream 22 may be cooled in an air cooler 63 and expanded across valve 67, producing a chilled refrigerant stream 24, which may be returned to the LNG liquefaction heat exchanger 66. The chilled refrigerant stream 24 may cool the cold high pressure gas stream 12, thereby producing an LNG product stream 14.

As an example of suitable conditions of the process shown in FIG. 1, the natural gas stream 1 at a flow rate of about 100 to 200 million metric standard cubic feet per day (MMscfd) may be supplied at a pressure of about 250 to 600 psig with the following composition: 1.0 mol % $N_2$, 0.1 mol % $CO_2$, 96.5 mol % methane, 2 mol % ethane, and 0.5 mol % propane and heavier components (e.g., $C_{4+}$ hydrocarbons). The natural gas stream 1 may be treated in an acid gas removal unit 51 for removal of $H_2S$ and $CO_2$ (which may leave the acid gas removal unit 51 as stream 2) forming a treated gas stream 3 with less than about 50 ppmv of $CO_2$. The treated gas stream 3 may be dried in a molecular sieve dryer unit 52 where mercury content is removed, producing a dried gas stream 5 that is fed to compressor 53, which is driven by an electric motor.

The dried gas stream 5 is compressed by compressor 53 to about 900 to 1300 psig, forming stream 8, which is then cooled in air cooler 60 to about 60° to 110° F. forming stream 9. The cooled gas stream 9 may be further compressed by compressor 54 to about 1800 to 2500 psig (driven by expander 55) forming stream 10, and may be cooled in air cooler 61 to about 60° F. to 110° F. forming a high pressure gas stream 11. The outlet temperature for the one or more air coolers may depend on ambient temperature on-site, and preferably in a cold climate region as gas compression horsepower can be significantly reduced in a colder ambient temperature.

The high pressure gas stream 11 is expanded in expander 55 to about 900 to 1100 psig, as required to operate the LNG liquefaction plant. Power generated in the expansion process of the expander 55 is used to drive compressor 54 while the expansion process also chills the gas to about −10° F. to 20° F. The cold high pressure gas stream 12 is then fed to the LNG liquefaction heat exchanger 66.

In the refrigeration circuit 120, low pressure refrigerant stream 19 at a pressure between about 450 to 600 psig may be compressed in the low pressure compressor 57 to an intermediate pressure, forming stream 20. The compressed stream 20 may be cooled in air cooler 64 forming stream 21, which may be further compressed by compressor 56 to about 1300 to 2000 psig, forming stream 22. The high pressure gas stream 22 may be cooled in air cooler 63 and expanded across valve 67 to produce a chilled refrigerant stream 24 prior to being returned to the LNG liquefaction heat exchanger 66 and producing LNG product stream 14.

Figure 3:
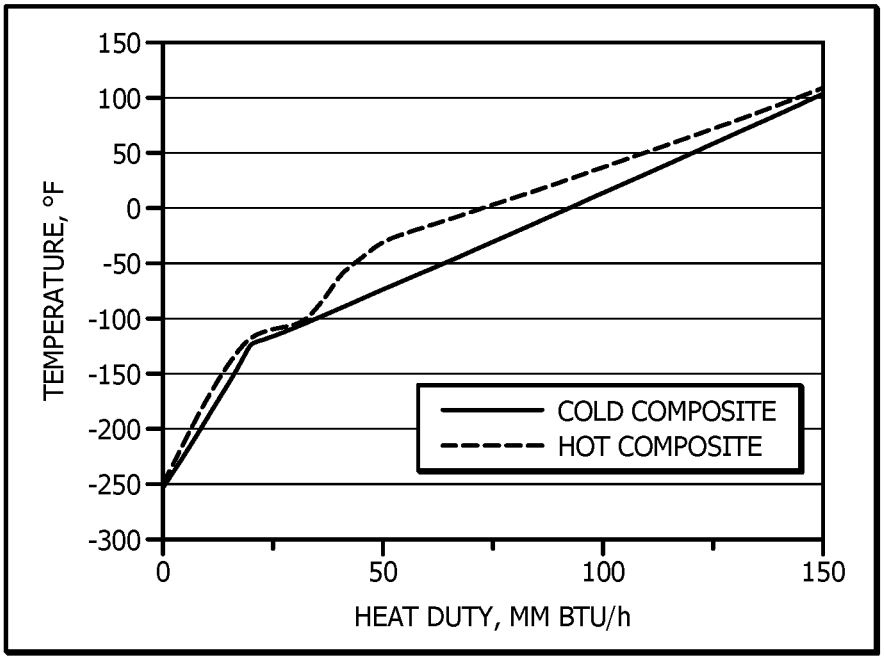
FIG. 3 illustrates a composite heat curve according to an embodiment of the disclosure.
Figure 4:
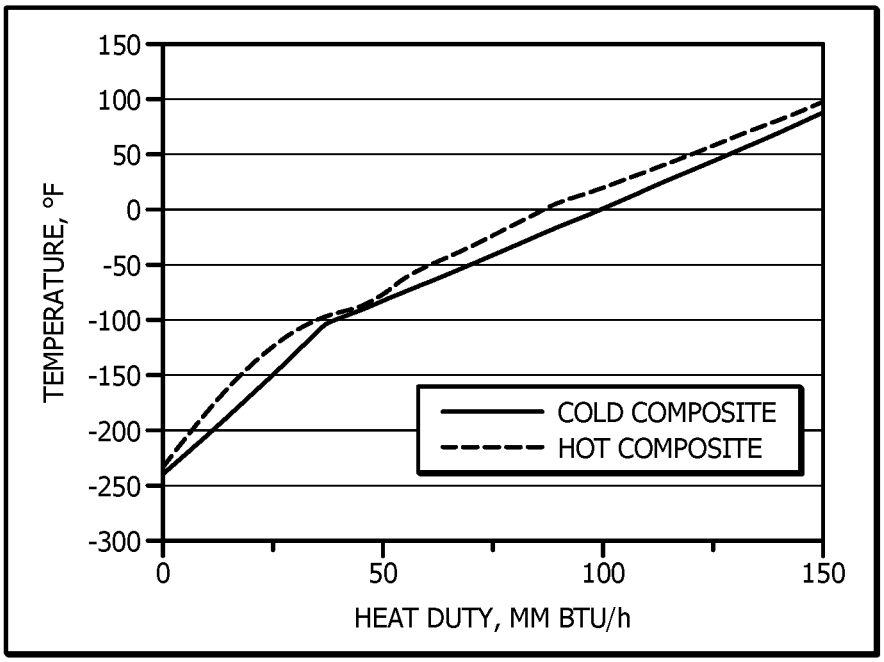
FIG. 4 illustrates another composite heat curve according to an embodiment of the disclosure.

The contemplated process 100 described above can reduce the specific liquefaction power (kW/ton), which is demonstrated by the composite heat curves shown in FIG. 3 and FIG. 4. FIG. 3 shows the composite heat curves of a conventional process for the LNG liquefaction exchanger prior to the installation of the contemplated process. As shown in FIG. 3, conventional cycle incurs wider temperature approaches, particularly in the middle section of the heat curves, which explains its inefficiency. FIG. 4 shows the heating and cooling curves after installation of the contemplated process demonstrating the close temperature approaches and high efficiency, as thermodynamic losses are minimized. Thermal efficiency may be improved by about 5 to 20%, and may in some embodiments be improved by about 10 to 15%.

Figure 2:
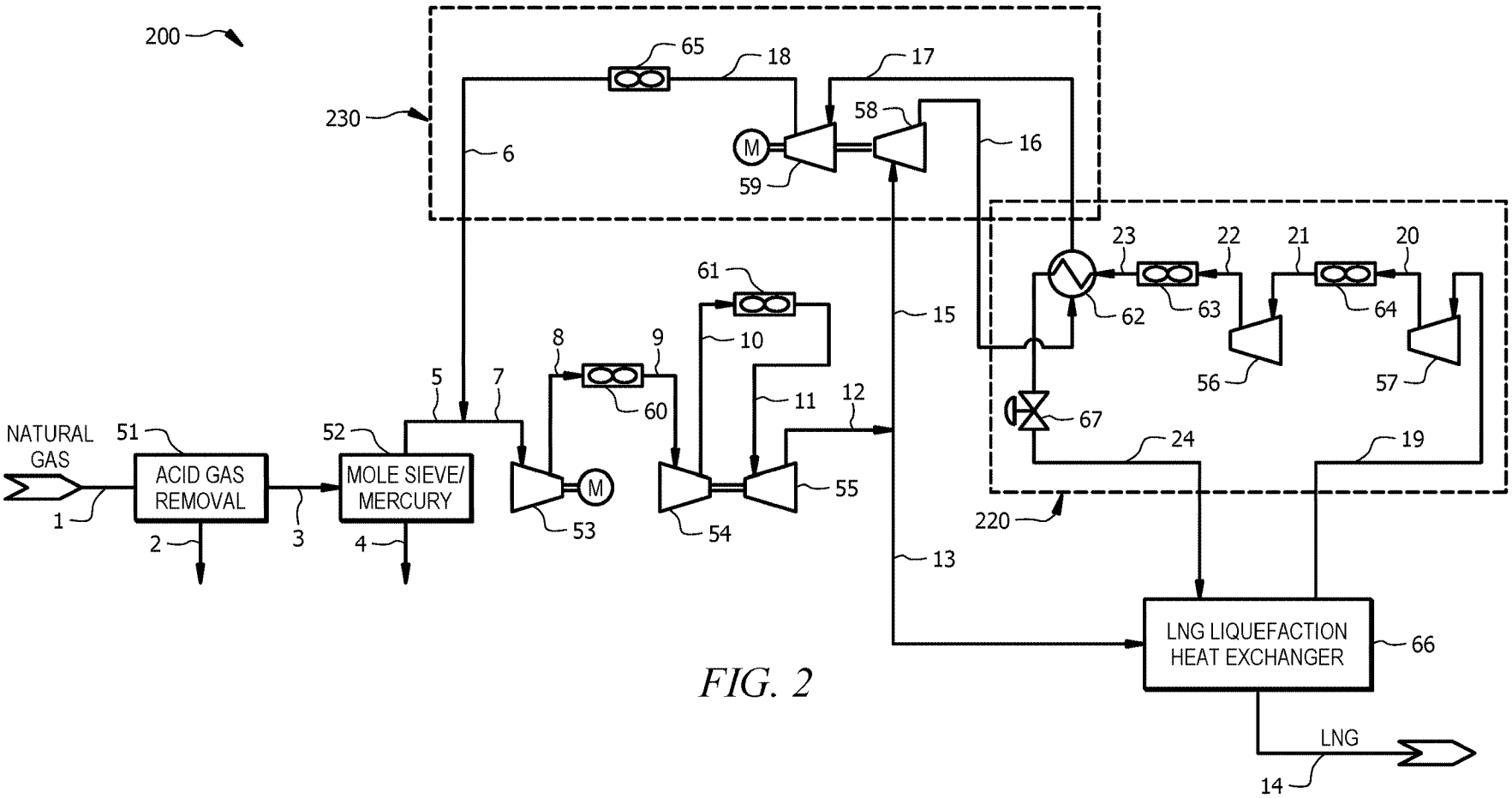
FIG. 2 illustrates a process including a refrigeration circuit and a second expansion stage according to an embodiment of the disclosure.

Referring now to FIG. 2, refrigeration can also be produced using a second expansion stage 230 in addition to a refrigeration circuit 220. The process 200 may be similar to the process 100 described in FIG. 1, where only the new parts of the process are described below, and the description of the elements shown in FIG. 1 is hereby repeated.

In addition to providing a cold and high pressure gas to the LNG plant, the cold high pressure gas stream 12 from expander 55 may be split into two portions: stream 13 and stream 15. Stream 13 may be fed to the LNG liquefaction heat exchanger 66 (as described in FIG. 1) while stream 15 may be further expanded in expander 58, producing a chilled gas stream 16, which may be heat exchanged in exchanger 62 with the refrigerant stream 23, producing a chilled refrigerant stream 24. The expanded stream 17 may be compressed by compressor 59 producing stream 18, which may be cooled in air cooler 65 to produce recycle stream 6. Recycle stream 6 may be recycled back to mix with the feed stream 5, producing combined stream 7 which is fed to the compressor 53 (as described in FIG. 1). Power generated by expander 58 may be used to supply a portion of the power of compressor 59. Additional power may be supplied by a motor, steam turbine, or gas engine.

As an example of suitable conditions of the process shown in FIG. 2, stream 15 may be further expanded in expander 58 to about 300 to 600 psig, producing the chilled gas stream 16 at about −10° to −30° F. Additionally, the streams 13 and 15 can be split in a ratio of the flowrate of stream 13 to stream 15 in a range of between about 1:4 to about 4:1 or between about 1:2 to 2:1, or about 1:1.

While contemplated methods and plants presented herein may have any capacity, it should be appreciated that such plants and methods are especially suitable for a small to mid-scale LNG plant having capacity of between about 0.2 to 0.7 mmtpy, between about 0.7 to 1.5 mmtpy, and/or between about 1.5 to 2.5 mmtpy of LNG production by liquefaction of appropriate quantities of feed gas. Consequently, contemplated plants and methods may be implemented at any location where substantial quantities of natural gas are available, and especially preferred locations include oil and gas producing wells, gasification plants (e.g., coal and other carbonaceous materials), and at decentralized locations using gas from a natural gas pipeline. Thus, it should be recognized that the feed gas composition may vary considerably, and that depending on the type of gas composition, one or more pre-treatment units may be required. For example, suitable pre-treatment units include dehydration units, acid gas removal units, mercury removal units, mercaptan removal units, etc.

Having described various devices and methods herein, exemplary embodiments or aspects can include, but are not limited to:

In a first embodiment, a system for pre-cooling a natural gas stream to a liquefaction plant may comprise a compressor configured to receive a first natural gas stream at a first pressure and produce a second natural gas stream at a second pressure; an exchanger, wherein the exchanger is configured to receive the second natural gas stream as the second pressure and cool the second natural gas stream to produce a cooled natural gas stream; and an expander, wherein the expander is configured to receive the cooled natural gas stream and expand the cooled natural gas stream from the second pressure to a third pressure.

A second embodiment can include the system of the first embodiment, wherein the exchanger is an ambient air exchanger configured to exchange heat between the second natural gas stream at the second pressure and an ambient air stream.

A third embodiment can include the system of the first or second embodiments, further comprising a second compressor configured to receive a natural gas feed stream at a fourth pressure and produce a fourth natural gas stream at the first pressure, wherein the first pressure is higher than the fourth pressure; and a second exchanger, wherein the second exchanger is configured to receive the fourth natural gas stream at the first pressure and cool the natural gas stream to produce the first natural gas stream.

A fourth embodiment can include the system of the third embodiment, wherein the natural gas stream at the third pressure is cooler than the natural gas stream at the fourth pressure.

A fifth embodiment can include the system of the third or fourth embodiments, wherein the third pressure is greater than the fourth pressure.

A sixth embodiment can include the system of any of the first to fifth embodiments, further comprising an LNG liquefaction system configured to receive the cooled natural gas stream at the third pressure.

A seventh embodiment can include the system of any of the first to sixth embodiments, wherein the compressor and the expander are mechanically coupled.

In an eighth embodiment, a system may comprise a first compressor configured to receive a natural gas feed stream at a first pressure and compress the natural gas feed stream to produce a first compressed stream at a second pressure; a first heat exchanger configured to cool the first compressed stream at the second pressure; a second compressor configured to receive the first compressed stream at the second pressure and compress the first compressed stream to produce a second compressed stream at a third pressure; a second heat exchanger configured to cool the second compressed stream at the third pressure; an expander configured to receive the second compressed stream at the third pressure from the second heat exchanger and expand the second compressed stream to produce an expanded natural gas stream at a fourth pressure; and an LNG liquefaction system comprising a refrigeration loop, wherein the refrigeration loop comprises a heat exchanger configured to receive at least a portion of the expanded natural gas stream as a cooling stream in the refrigeration loop.

A ninth embodiment can include the system of the eighth embodiment, wherein the second compressor and the expander are mechanically coupled.

A tenth embodiment can include the system of the eighth or ninth embodiments, wherein the LNG liquefaction system is configured to receive a second portion of the expanded natural gas stream and condense the second portion of the expanded natural gas stream.

In an eleventh embodiment, a method may comprise compressing and cooling a natural gas stream to produce a compressed natural gas stream, wherein the natural gas stream is at a first pressure and a first temperature; and expanding the compressed natural gas stream to produce a chilled natural gas stream, wherein the chilled natural gas stream is at a second pressure and a second temperature, wherein the first temperature is higher than the second temperature.

A twelfth embodiment can include the method of the eleventh embodiment, wherein the second pressure is higher than the first pressure.

A thirteenth embodiment can include the method of the eleventh or twelfth embodiments, wherein the cooling occurs in an ambient air exchanger.

A fourteenth embodiment can include the method of any of the eleventh to thirteenth embodiments, further comprising compressing and cooling a natural gas feed stream to produce the natural gas stream, wherein the natural gas feed stream is at a third pressure and a third temperature.

A fifteenth embodiment can include the method of the fourteenth embodiment, further comprising condensing at least a portion of any $C_{4+}$, aromatics, or both in response to compressing and cooling the natural gas feed stream.

A sixteenth embodiment can include the method of the fourteenth or fifteenth embodiments, wherein the third temperature is higher than the second temperature.

A seventeenth embodiment can include the method of any of the fourteenth to sixteenth embodiments, wherein the third pressure is lower than the second pressure.

An eighteenth embodiment can include the method of any of the eleventh to seventeenth embodiments, further comprising heat exchanging a first portion of the chilled natural gas stream with a refrigerant in an LNG liquefaction heat exchanger; condensing at least a portion of the first portion of the chilled natural gas stream in the LNG liquefaction heat exchanger; expanding a second portion of the chilled natural gas stream to produce an expanded chilled natural gas stream; heat exchanging the expanded chilled natural gas stream with the refrigerant; and cooling the refrigerant in response to heat exchanging the expanded chilled natural gas stream with the refrigerant.

A nineteenth embodiment can include the method of any of the eleventh to eighteenth embodiments, further comprising condensing at least a portion of any $C_{4+}$, aromatics, or both in response to compressing and cooling the natural gas stream.

A twentieth embodiment can include the method of any of the eleventh to nineteenth embodiments, wherein the compressing of the natural gas stream is performed by a compressor, wherein the expanding of the compressed natural gas stream is performed by an expander, and wherein the compressor and the expander are mechanically coupled.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of." Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A system for pre-cooling a natural gas stream the system comprising:

a compressor configured to receive a first natural gas stream at a first pressure and produce a second natural gas stream at a second pressure;

an exchanger, wherein the exchanger is configured to receive the second natural gas stream at the second pressure and cool the second natural gas stream to produce a cooled natural gas stream;

an expander, wherein the expander is configured to receive the cooled natural gas stream and expand the cooled natural gas stream from the second pressure to a third pressure; and a liquid natural gas (LNG) liquefaction system comprising a refrigeration loop, wherein the liquid natural gas (LNG) liquefaction system is configured to receive a first portion of the cooled natural gas stream at the third pressure in a first heat exchanger of the refrigeration loop and to receive a second portion of the cooled natural gas stream as a cooling stream in a second heat exchanger of the refrigeration loop.

2. The system of claim 1, wherein the exchanger is an ambient air exchanger configured to exchange heat between the second natural gas stream at the second pressure and an ambient air stream.

3. The system of claim 1, further comprising:

a second compressor configured to receive a natural gas feed stream at a fourth pressure and produce a fourth natural gas stream at the first pressure, wherein the first pressure is higher than the fourth pressure; and a second exchanger, wherein the second exchanger is configured to receive the fourth natural gas stream at the first pressure and to cool the fourth natural gas stream to produce the first natural gas stream.

4. The system of claim 3, wherein the cooled natural gas stream at the third pressure is cooler than the natural gas feed stream at the fourth pressure.

5. The system of claim 3, wherein the third pressure is greater than the fourth pressure.

6. The system of claim 1, wherein the compressor and the expander are mechanically coupled.

7. A system comprising:

a first compressor configured to receive a natural gas feed stream at a first pressure and compress the natural gas feed stream to produce a first compressed stream at a second pressure;

a first heat exchanger configured to cool the first compressed stream at the second pressure;

a second compressor configured to receive the first compressed stream at the second pressure and compress the first compressed stream to produce a second compressed stream at a third pressure;

a second heat exchanger configured to cool the second compressed stream at the third pressure;

an expander configured to receive the second compressed stream at the third pressure from the second heat exchanger and expand the second compressed stream to produce an expanded natural gas stream at a fourth pressure; and a liquid natural gas (LNG) liquefaction system comprising a refrigeration loop, wherein the refrigeration loop comprises a third heat exchanger configured to receive at least a portion of the expanded natural gas stream as a cooling stream in the refrigeration loop, wherein the LNG liquefaction system is configured to receive a second portion of the expanded natural gas streaam and to condense the second portion of the expanded natural gas stream.

8. The system of claim 7, wherein the second compressor and the expander are mechanically coupled.

9. A method comprising:

compressing and cooling a natural gas stream to produce a compressed natural gas stream, wherein the natural gas stream is at a first pressure and a first temperature;

expanding the compressed natural gas stream to produce a chilled natural gas stream, wherein the chilled natural gas stream is at a second pressure and a second temperature, wherein the first temperature is higher than the second temperature;

heat exchanging a first portion of the chilled natural gas stream with a refrigerant in a liquid natural gas (LNG) liquefaction heat exchanger;

condensing at least a portion of the first portion of the chilled natural gas stream in the LNG liquefaction heat exchanger;

expanding a second portion of the chilled natural gas stream to produce an expanded chilled natural gas stream;

heat exchanging the expanded chilled natural gas stream with the refrigerant; and cooling the refrigerant in response to heat exchanging the expanded chilled natural gas stream with the refrigerant.

10. The method of claim 9, wherein the second pressure is higher than the first pressure.

11. The method of claim 9, wherein the cooling occurs in an ambient air exchanger.

12. The method of claim 9, further comprising compressing and cooling a natural gas feed stream to produce the natural gas stream, wherein the natural gas feed stream is at a third pressure and a third temperature.

13. The method of claim 12, further comprising condensing at least a portion of any $C_{4+}$, aromatics, or both in response to compressing and cooling the natural gas feed stream.

14. The method of claim 12, wherein the third temperature is higher than the second temperature.

15. The method of claim 12, wherein the third pressure is lower than the second pressure.

16. The method of claim 9, further comprising condensing at least a portion of any $C_{4+}$, aromatics, or both in response to compressing and cooling the natural gas stream.

17. The method of claim 9, wherein the compressing of the natural gas stream is performed by a compressor, wherein the expanding of the compressed natural gas stream is performed by an expander, and wherein the compressor and the expander are mechanically coupled.

* * * * *